US005787861A

United States Patent [19]

Suzuki et al.

[11] Patent Number: 5,787,861

[45] Date of Patent: Aug. 4, 1998

[54] THROTTLE VALVE CONTROL DEVICE OF ENGINE

[75] Inventors: Mikihiko Suzuki; Takeshi Sugiyama, both of Tokyo, Japan

[73] Assignee: Mitsubishi Denki Kabushiki Kaisha, Tokyo, Japan

[21] Appl. No.: 820,090

[22] Filed: Mar. 19, 1997

[30] Foreign Application Priority Data

Oct. 18, 1996 [JP] Japan ..... 8-276054

[51] Int. Cl.[6] ..... F02D 41/22

[52] U.S. Cl. ..... 123/396; 123/399; 123/400

[58] Field of Search ..... 123/399, 400, 123/396, 361

[56] References Cited

U.S. PATENT DOCUMENTS

| | | | |
|---|---|---|---|
| 5,074,266 | 12/1991 | Kuhn et al. | 123/361 |
| 5,215,057 | 6/1993 | Sato et al. | 123/400 |
| 5,367,997 | 11/1994 | Kawamura et al. | 123/399 |
| 5,669,351 | 9/1997 | Shirai et al. | 123/339.21 |

FOREIGN PATENT DOCUMENTS

| | | | |
|---|---|---|---|
| B-63-150449 | 6/1988 | Japan | F02D 41/20 |
| A-4-203219 | 7/1992 | Japan | F02D 9/02 |

*Primary Examiner*—Tony M. Argenbright
*Assistant Examiner*—Hieu T. Vo
*Attorney, Agent, or Firm*—Sughrue, Mion, Zinn, Macpeak & Seas, PLLC

[57] ABSTRACT

A throttle valve control device of an engine including a throttle valve pivotally arranged about a throttle valve shaft in a suction path of an engine, and a controller which controls the opening degree of the throttle valve in accordance with the amount of acceleration and which controls the throttle valve to pivot to a predetermined opening degree when a throttle valve driver is deactivated. The throttle valve is pivotal in a predetermined range of 90° or more exceeding a control angular range in a normal control between a predetermined angular position for a minimum control opening degree and a predetermined angular position for a maximum control opening degree where a stopper is provided to regulate the pivoting of the throttle valve.

8 Claims, 4 Drawing Sheets

THROTTLE VALVE CONTROL DEVICE OF ENGINE

BACKGROUND OF THE INVENTION

FIELD OF THE INVENTION

The present invention relates to a throttle valve control device of an engine for electrically controlling a throttle valve in a suction path of the engine in accordance with an amount of pushing on an accelerator.

DISCUSSION OF BACKGROUND

In a conventional device of this kind, there is provided a spring urging the throttle valve in a closing direction to prevent the engine from excessively rotating against the intention of a driver when a motor for driving the throttle valve cannot be driven due to malfunction of the motor, connection failure of connectors, malfunction of a control circuit or the like (when the motor is deactivated) and the throttle valve is disposed at a fully closed position when the motor is deactivated.

However, under this constitution, when the throttle valve is fully closed, the engine can be driven only by idling. In the malfunction of the throttle valve escape running of a vehicle mounted with the engine cannot be conducted. Iced fixing of the throttle valve is liable to occur at cold regions. Accordingly, in order to resolve the drawbacks, there has been proposed a throttle valve control device having the structure where the throttle valve is mechanically held at a predetermined opening degree between a fully closed position and a fully opened position when the motor for driving the throttle valve is deactivated, as disclosed in, for example, Japanese Unexamined Patent Publication No. JP-A-63-150449 or Japanese Unexamined Patent Publication No. JP-A-4-203219.

According to the conventional devices disclosed in the above-mentioned respective publications, the mechanically set opening degree position of the throttle valve in deactivating the motor for driving the throttle valve, is located in a control angular range of the throttle valve of approximately 90° for running the engine. In order to hold the throttle valve at the set opening degree position in the control angular range, there have been provided a first spring for urging the throttle valve in the fully closing direction and a second spring (elastic body) for urging the throttle valve in the fully opening direction against the first spring at a predetermined opening degree or less of the throttle valve. However, the performance of the urging force operating on the throttle valve considerably differs by an angular range where only the first spring operates on the throttle valve in the fully closing direction and an angular range where a synthesized force of the first and the second springs operates thereon in the fully opening direction.

Accordingly, when the opening degree of the throttle valve is controlled over the control angular range by a balance between the urging force and the drive force of the motor for driving the throttle valve, control amounts (drive direction, current value) of the motor is needed to determine in correspondence with the change in the performance of the urging force. However, it is difficult to determine the control amount for providing a target control opening degree by an open loop control due to the shift of the performance of the urging force or hysteresis. Therefore, a feed back control is conducted such that the output from a sensor of the throttle valve opening degree becomes the target control opening degree. However, the response of the feed back control is considerably changed in the control angular range of the throttle valve since the performance of the urging force is significantly changed, which deteriorates the controllability. Especially, the deterioration in the controllability is conspicuously manifested when the throttle valve is controlled traversing an inflection point of the performance of the urging force.

Furthermore, according to the conventional device two kinds of the springs (elastic member) are needed for urging the throttle valve in the fully closing direction and the fully opening direction whereby the structure is complicated.

SUMMARY OF THE INVENTION

The present invention has been carried out in order to resolve the above-described problems and it is an object of the present invention to provide a throttle valve control device of an engine whereby a throttle valve control excellent in the controllability is realized by dispensing with an inflection point of an urging force performance of a spring in a normal control angular range of a throttle valve and the structure is simplified by maintaining the throttle valve at a predetermined opening degree only by a one-directionally urging spring when a throttle valve drive means is deactivated.

According to a first aspect of the present invention, there is provided a throttle valve control device of an engine comprising:

a throttle valve installed pivotably to a throttle valve shaft as a center of pivoting in a suction path of the engine;

a control means for generating a control signal for controlling an opening degree of the throttle valve in accordance with at least an amount of pushing on an accelerator;

a drive means for controlling to drive the throttle valve in accordance with the control signal;

wherein the throttle valve is constituted to be pivotable in a predetermined angular range of 90° or more exceeding a control angular range in a normal control between a predetermined angular position for a minimum control opening degree and a predetermined angular position for a maximum control opening degree and is comprising:

a stopper for regulating to pivot the throttle valve at a predetermined angular position out of the control angular range such that the throttle valve provides a predetermined opening degree when the drive means is deactivated; and a spring urging the throttle value in a rotational direction from the control angular range toward the stopper.

According to a second aspect of the present invention, there is provided the throttle valve control device of an engine according to the first aspect, wherein the throttle valve is constituted to be pivotable up to a position of the stopper exceeding the angular position of the minimum control opening degree in the control angular range and the spring urges the throttle valve in the rotational direction from the angular position of the maximum control opening degree toward the stopper via the angular position of the minimum control opening degree.

According to a third aspect of the present invention, there is provided the throttle valve control device of an engine according to the first aspect, wherein the throttle valve is constituted to be pivotable up to a position of the stopper exceeding the angular position of the maximum control opening degree of the control angular range and the spring urges the throttle valve in the rotational direction from the angular position of the minimum control opening degree toward the stopper via the angular position of the maximum control opening degree.

According to a fourth aspect of the present invention, there is provided the throttle valve control device of an engine according to the first aspect, further comprising:

a sensor for detecting a rotational angular position of the throttle valve; and wherein the control means generates the control signal such that a detected rotational angular position of the throttle valve provided by the sensor coincides with a target rotational angular position of the throttle valve.

According to a fifth aspect of the present invention, there is provided the throttle valve control device of an engine according to the first aspect, wherein the drive means comprises a motor and a rotation of the motor is transmitted to the throttle valve shaft via gears.

According to a sixth aspect of the present invention, there is provided the throttle valve control device of an engine according to the first aspect, wherein the control means controls the throttle valve in accordance with a starting operation of the engine from a position of the stopper to an angular position of a predetermined starting opening degree in the normal control angular range.

DETAILED DESCRIPTION OF THE PREFERRED EMBODIMENTS

An explanation will be given of Embodiments of the present invention in reference to the drawings.

EMBODIMENT 1

Figure 1:
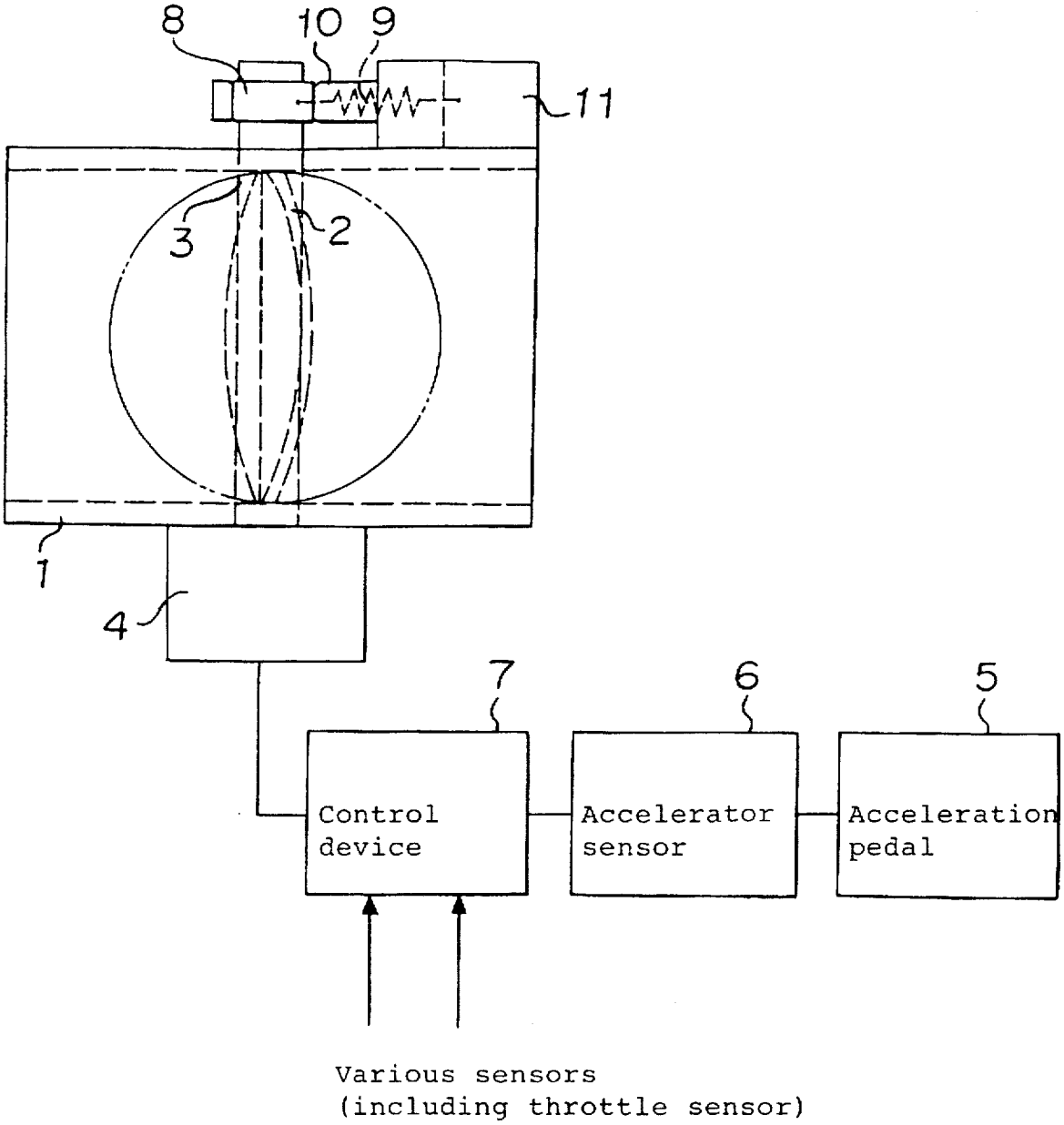
FIG. 1 is a constitutional view of a device according to Embodiment 1 of the present invention.
Figure 2:
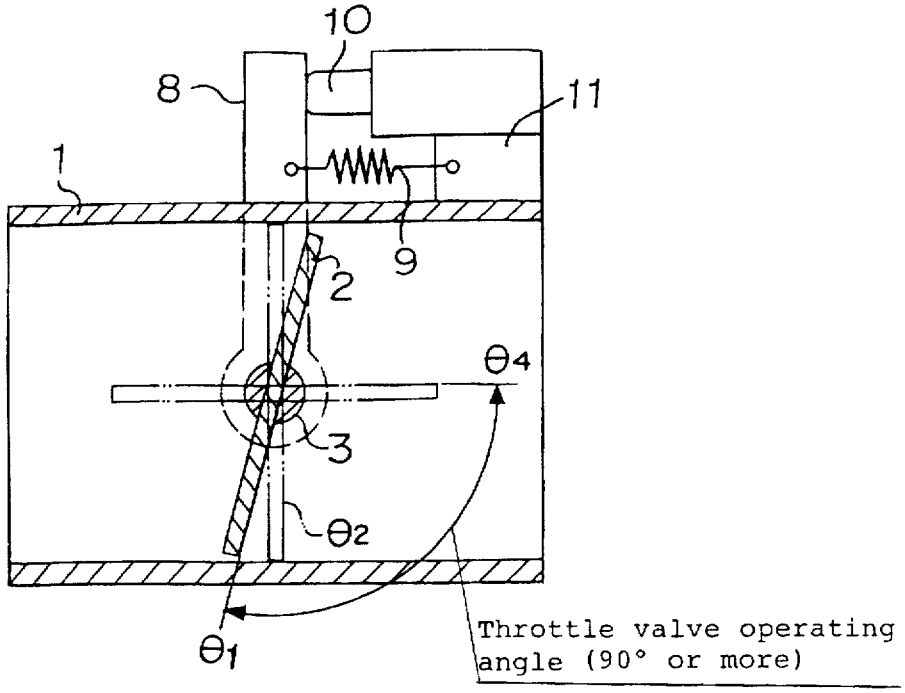
FIG. 2 is a sectional view of essential portions of the device of FIG. 1.
Figure 3:
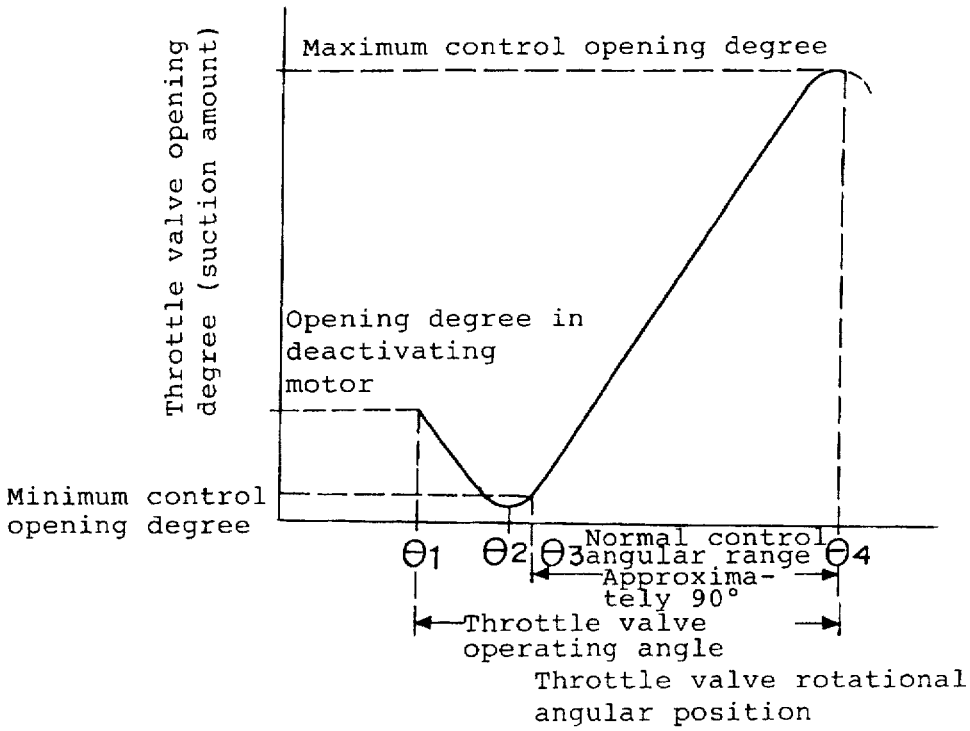
FIG. 3 is a characteristic diagram of a throttle valve opening degree in respect of a rotational angular position of a throttle valve in the device of FIG. 1.
Figure 4:
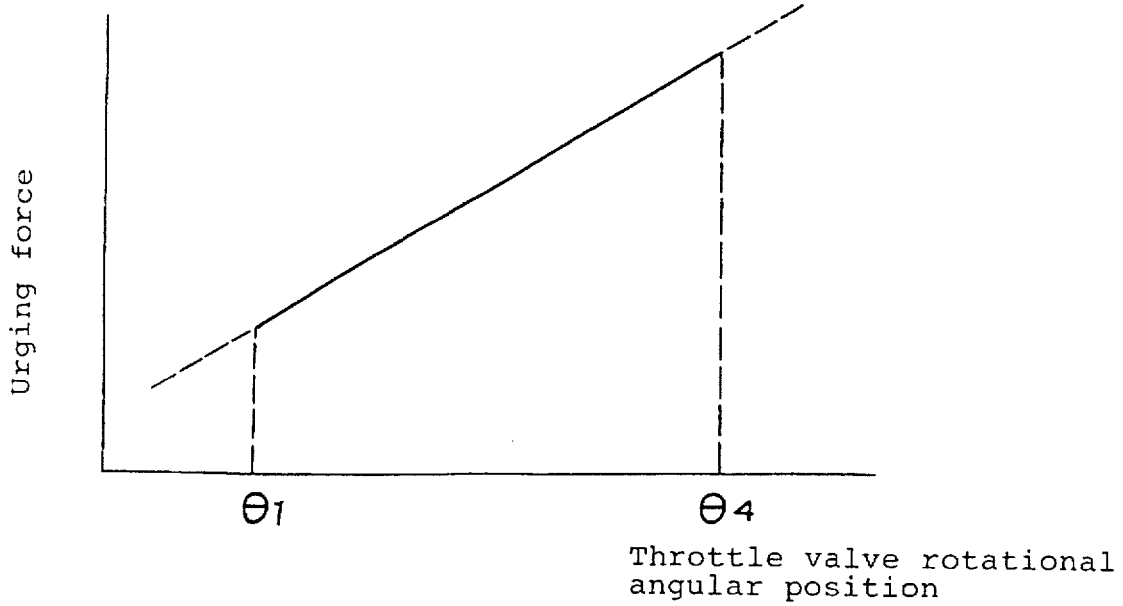
FIG. 4 is a characteristic diagram of an urging force of a spring in respect of the rotational angular position of the throttle valve in the device of FIG. 1.

FIG. 1 is a constitutional view of a throttle valve control device according to Embodiment 1 of the present invention. FIG. 2 is a sectional view of essential portions of the device of FIG. 1. FIG. 3 and FIG. 4 are a characteristic diagram of an opening degree of a throttle valve in respect of a rotational angular position of a throttle valve and a characteristic diagram of an urging force of a spring in respect of a rotational angular position of a throttle valve for explaining the operation of a throttle valve control device according to Embodiment 1 of the present invention.

In FIG. 1 and FIG. 2 numeral 1 designates a suction tube constituting a portion of a suction path of an engine which is formed in a cylindrical shape. Numeral 2 designates a throttle valve in a disk-like shape arranged in the suction tube 1, which is fixed to a throttle valve shaft 3 rotatably provided to the suction tube 1 by penetrating it and the throttle valve conducts a throttling control of the suction path by being pivoted centering on the throttle valve shaft 3. A rotational shaft of a direct current motor 4 for driving the throttle valve that is attached to the suction tube 1 is connected to one end of the throttle valve shaft 3. The motor 4 is driven by a control signal from a control device 7 for determining the rotational angular position of the throttle valve 2 in accordance with an output signal from an accelerator sensor 6 for detecting an operating amount (push-on amount) of an acceleration pedal 5 operated by a driver, an output signal from a throttle sensor for detecting the rotational angular position of the throttle valve 2 although not illustrated, or the like. Further, a lever 8 is fitted to the other end of the throttle valve shaft 2 and the lever 8 is pivoted integrally with the throttle valve 2. Numeral 9 designates a tension spring provided between a fixed member 11 installed integrally with the suction pipe 1 and the lever 8, which urges the throttle valve 2 in the clockwise direction of FIG. 2. Numeral 10 designates a stopper which is installed to the fixed portion 11 and is brought into contact with an end portion of the lever 8 for regulating the throttle valve to pivot to a predetermined rotational angular position such that the throttle valve provides a predetermined opening degree when the motor is deactivated.

Here, an explanation will be given of the operational angle of the throttle valve 2 in reference also to FIG. 3. Firstly, as shown by FIG. 2 the outer shape of the throttle valve 2 is in an approximately circular form and the dimension is set slightly smaller than the inner peripheral dimension of the suction tube 1 such that the throttle valve can be rotated to pass through a fully closed rotational angular position $\theta_2$ completely orthogonal to the suction flow. Next, the normal control angular range of the throttle valve 2 driven by the motor 4 in operating an engine, needs to set in a range from the fully closed rotational angular position $\theta_2$ to a fully opened rotational angular position $\theta_4$ where the throttle valve is completely in parallel to the suction flow. Actually, the rotational angular position determining a maximum control opening degree (an angular position at a maximum controlled opening degree) is substantially set to the fully opened rotational angular position $\theta_4$ regulated by a mechanical mechanism, not illustrated. Further, the rotational angular position determining a minimum control opening degree (an angular position at a minimum controlled opening degree) is set to a rotational angular position $\theta_3$ which is disposed a little ahead of the fully closed rotational angular position $\theta_2$ such that the throttle valve does not exceed the fully closed rotational angular position $\theta_2$ during the control operation. Therefore, the normal control angular range is provided with a value slightly smaller than 90° (approximately 90°).

Further, when the motor 4 is deactivated, the throttle valve 2 is pivoted by the spring 9 to a predetermine rotational angular position $\theta_1$ (a pivot regulating position that is produced by bringing the stopper 10 and lever 8 into contact with each other) which is disposed out of the control angular range by exceeding the fully closed rotational angular position $\theta_2$. Therefore, the operational angle of the throttle valve 2 ranges from the rotational angular position $\theta_1$ exceeding 90° to $\theta_4$.

The spring 9 urges the throttle valve in a rotational direction from the control angular range toward the stopper 10. As shown by FIG. 4, the urging force is provided with a predetermined initial urging force at the pivot regulating position $\theta_1$ prescribed by the stopper and the urging force is increased in accordance with the change in the rotational angle toward the fully opened rotational angular position $\theta_4$ via the fully closed rotational angular position $\theta_2$ with an inclination determined by the spring constant of the spring 9.

An explanation will be given of the operation of the device constituted as described above.

When the power source of the device is made OFF and the engine is stopped, the throttle valve 2 is urged in the clockwise direction of FIG. 2 by the spring 9 and as shown by FIG. 2, the throttle valve 2 is regulated to pivot to the rotational angular position $\theta_1$ where the lever 8 is brought into contact with the stopper 10 whereby the throttle valve opening degree is held. The opening degree of the throttle valve in this case is set to an opening degree capable of securing a suction amount necessary for driving and transporting a vehicle up to a maintenance shop even if abnormality in electrical systems such as the motor 4, the control device 7 or the like occurs and the motor 4 does not drive the throttle valve and it is set to a predetermined intermediate opening degree which is larger than a predetermined opening degree in idling.

Now, when a driver switches on the power source of the device and the starting operation of the engine is initiated, the control device 7 determines a controlled target rotational angular position providing a start opening degree of the throttle valve suitable for starting the engine in the normal control angular range, and controls the throttle valve 2 at a rotational angular position providing the start opening degree in the normal control angular range by driving the motor 4 in accordance with the control signal determined by feeding back the detected output of the throttle sensor. Incidentally, the control of the throttle valve to the start opening degree may be carried out in accordance with turning of a start switch. Accordingly, a start-up performance is promoted since the opening degree suitable for starting the engine is provided in starting the engine.

When the starting of the engine is finished and the engine is operated under the normal control, the control device 7 determines the controlled target rotational angular position of the throttle valve in accordance with the output from the accelerator sensor 6 for detecting the amount of pushing on the acceleration pedal 5 by the driver and drives the motor 4 such that the output position of the throttle sensor is brought into agreement with the target rotational angular position. Therefore, the throttle valve 2 can accurately be controlled to the target opening degree. In this case, as shown by FIG. 4, the urging force of the spring 9 operating on the throttle valve 2 is provided with the characteristic having a continuity due to the spring constant of one kind of the spring urging the throttle valve in the closing direction in respect of all over the normal control angular range and therefore, a variation in the response of the opening and closing control of the throttle valve 2 is dispensed with and an a smooth control is realized whereby the controllability is improved When the motor 4 is deactivated since the power source is made OFF by the driver for stopping the engine or when electrical systems of the motor 4, the control device 7 or the like is malfunctioned, the throttle valve 2 is pivoted by the spring 9 to exceed the normal control angular range and up to the angular position $\theta_1$ (pivot position regulated by the stopper 10 and the lever 8) providing the predetermined throttle valve angle out of the normal control angular range and is stopped and held at that position. Accordingly, the engine can run to make the vehicle escape even in the above-described failure by the opening degree of the throttle valve 2 at that time.

According to the device of Embodiment 1, the rotational angular position $\theta_1$ of the throttle valve in deactivating the motor is set to the side exceeding the angular position of the minimum control opening in the normal control angular range and therefore, even in the above-described failure, the throttle valve reaches the predetermined angular position $\theta_1$ via the fully closed rotational angular position $\theta_2$ by the spring 9 and accordingly, there is no concern of excessive rotation in respect of the rotation number of the engine even instantaneously whereby the safety is promoted.

EMBODIMENT 2

Figure 5:
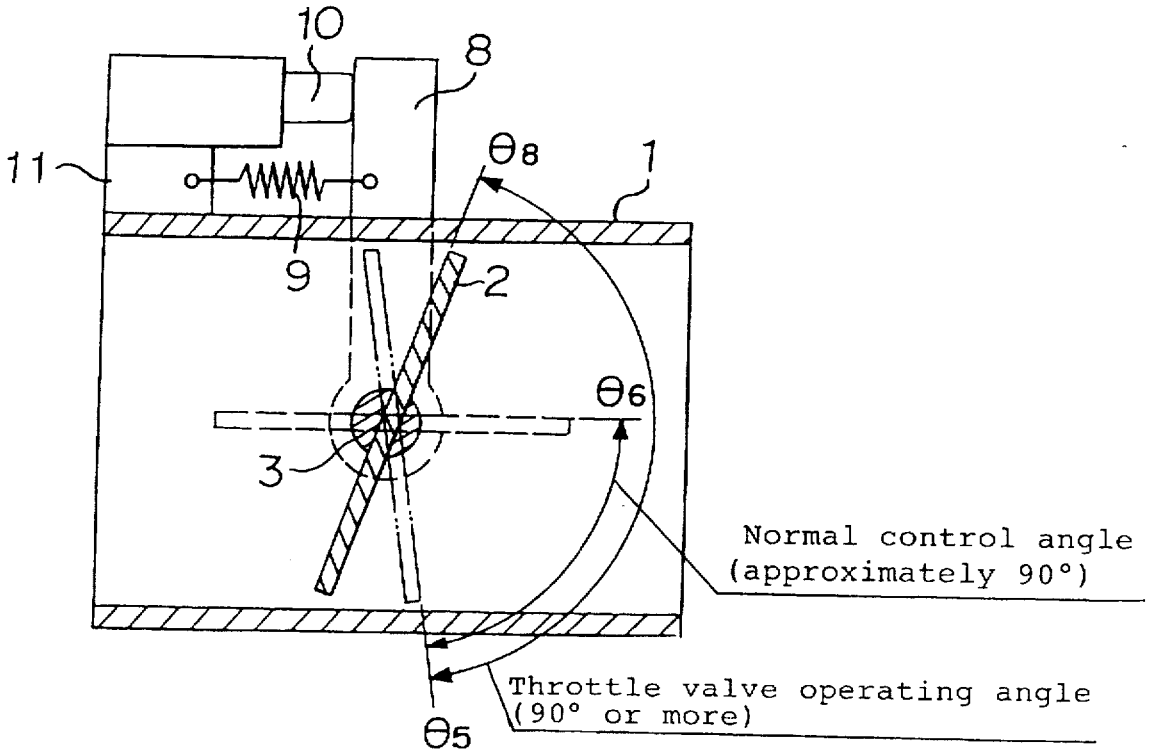
FIG. 5 is a sectional view of essential portions of a device according to Embodiment 2 of the present invention.
Figure 6:
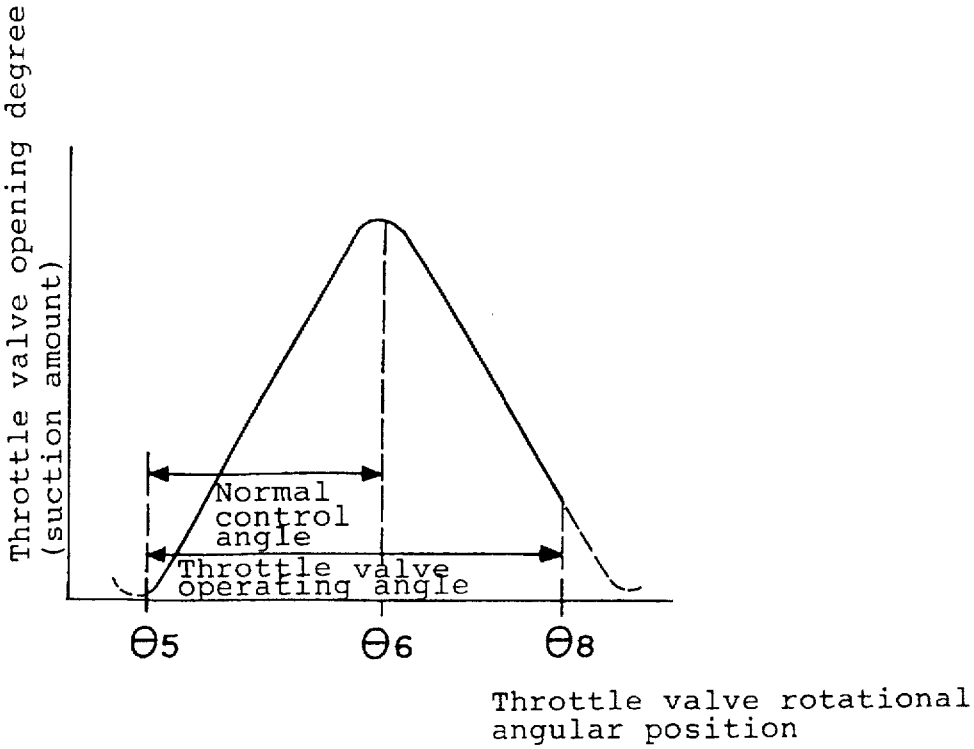
FIG. 6 is a characteristic diagram of an opening degree of a throttle valve in respect of a rotational angular position of a throttle valve in the device of FIG. 5.
Figure 7:
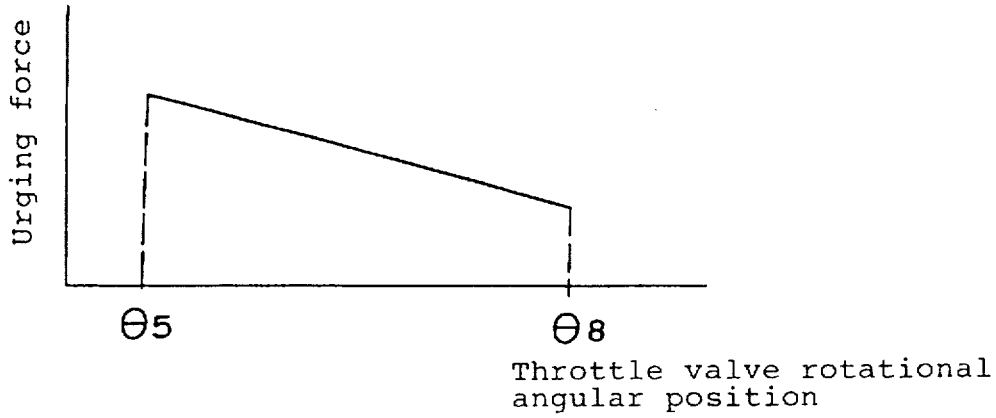
FIG. 7 is a characteristic diagram of an urging force of a spring in respect of the rotational angular position of the throttle valve of the device of FIG. 5.

FIG. 5 is a sectional view showing essential portions of a throttle valve control device according to Embodiment 2 of the present invention and FIG. 6 and FIG. 7 are characteristic diagrams of the opening degree of a throttle valve and the urging force of a spring in respect of the rotational angular position of the throttle valve for explaining the operation of the device of FIG. 5.

As shown by FIG. 5 and FIG. 6, according to the device of Embodiment 2, the operational angle of the throttle valve 2 ranges from an onset of a substantially fully closed angular position (angular position at a minimum control opening degree) $\theta_5$ that is mechanically regulated and extended from the normal control angular range of from the position $\theta_5$ to a substantially fully opened angular position (angular position at a maximum control opening degree) $\theta_6$ that is slightly smaller than 90° to a rotational angular range exceeding the maximum control opening degree position $\theta_6$, and the finish end is set to a predetermined angular position $\theta_8$ providing an opening degree of the throttle valve necessary for running the vehicle to escape in the above-described failure. The predetermined angular position $\theta_8$ is regulated by bringing the lever 8 and the stopper 10 into contact with each other and the spring 9 urges the throttle valve 2 in a rotational direction toward the stopper 10.

Accordingly, the spring 9 exerts the urging force in the direction of fully opening the throttle valve 2 in the normal control angular range as shown by FIG. 7 and the spring is only of one kind urging the throttle valve in the fully opening direction and therefore, the spring characteristic is not inflected whereby excellent controllability can be achieved. Incidentally, the motor 4 is controlled by the control device 7 such that the torque is increased toward the fully closing direction.

Additionally, when the motor 4 is deactivated in the above-described failure or the like, the throttle valve is pivoted by the spring 9 up to the predetermined angular position $\theta_8$ out of the normal control angular range whereby the vehicle can be run to escape.

According to the device of Embodiment 2, the throttle valve is driven to an angular position of a start opening degree from the predetermined angular position $\theta_8$ via the fully opened opening degree angular position $\theta_6$ in accordance with the starting operation of the engine. Further, when malfunction occurs, the throttle valve 2 is moved from a controlled angular position in the normal control angular range via the fully opened opening degree angular position $\theta_6$. In this way, the throttle valve 2 needs not to pass through the fully closed angular position as in the device of Embodiment 1 and accordingly, problems where the throttle valve 2 rubs or scuffs the inner wall of the suction pipe due to adhesion of deposit etc. caused in passing through the fully closed angular position, can be resolved.

Incidentally, according to the above-described respective Embodiments, the throttle valve is driven to the angular position of the starting opening degree in accordance with the starting operation of the engine (switching of power source, or making ON of a starting switch), however, the starting of the engine may be carried out at the angular position ($\theta_1$, $\theta_8$) of the throttle valve regulated by the stopper and the throttle valve may be controlled to pivot to the normal control angular range after finishing to start the engine. In this case, the motor can be driven stably in a state where the voltage of the power source is stabilized after finishing to start the engine.

Additionally, the torque transmission from the motor to the throttle valve shaft may be performed via a reduction gear mechanism. In this case, the urging force by the spring is one-directional and therefore, there is no change in the torque direction of the motor in controlling the throttle valve in the fully closing direction or fully opening direction whereby instability of control due to backlash of gear can be prevented from occurring.

According to the present invention, the throttle valve can be held at a predetermined opening degree when the throttle valve driving means is deactivated and therefore, the vehicle can be run to escape in failure and iced fixing of the throttle valve in cold regions is difficult to occur.

Furthermore, the throttle valve is urged by the spring up to the predetermined rotational angular position out of the normal control angular range of the throttle valve and therefore, the spring may be urged in one rotational direction and a portion in the normal control angular range of the throttle valve where the urging force of the spring is abruptly changed can be dispensed with whereby the controllability of the throttle valve control can be promoted. Furthermore, the invention achieves excellent effect whereby the constitution can be realized by an extremely simple structure.

What is claimed is:

1. A throttle valve control device for an engine, comprising:

a throttle valve shaft arranged in a suction path of the engine;

a throttle valve pivotally arranged about said throttle valve shaft;

control means for generating a control signal for controlling an opening degree of said throttle valve in accordance with at least an amount of acceleration;

drive means for driving said throttle valve in accordance with said control signal;

wherein said throttle valve is controlled to pivot within a predetermined angular range greater than 90° exceeding a control angular range in a normal control between a predetermined angular position for a minimum control opening degree and a predetermined angular position for a maximum control opening degree;

a stopper for regulating pivoting of said throttle valve at a predetermined angular position out of said control angular range such that said throttle valve provides a predetermined opening degree when said drive means is deactivated; and a spring urging said throttle valve in a rotational direction away from said control angular range toward said stopper.

2. The throttle valve control device according to claim 1, wherein said throttle valve is pivotal up to a position of said stopper exceeding the angular position of the minimum control opening degree in the control angular range and said spring urges said throttle valve in the rotational direction from the angular position of the maximum control opening degree toward said stopper via the angular position of the minimum control opening degree.

3. The throttle valve control device according to claim 1, wherein said throttle valve is pivotal up to a position of said stopper exceeding the angular position of the maximum control opening degree of the control angular range and said spring urges said throttle valve in the rotational direction from the angular position of the minimum control opening degree toward said stopper via the angular position of the maximum control opening degree.

4. The throttle valve control device according to claim 1, further comprising:

a sensor for detecting the rotational angular position of said throttle valve; and wherein said control means generates said control signal such that a detected rotational angular position of said throttle valve provided by said sensor coincides with a target rotational angular position of said throttle valve.

5. The throttle valve control device according to claim 1, wherein said drive means comprises a motor and gears, wherein rotation of said motor is transmitted to said throttle valve shaft via said gears.

6. The throttle valve control device according to claim 1, wherein said control means controls said throttle valve in accordance with a starting operation of said engine from a position of said stopper to an angular position of a predetermined starting opening degree in the normal angular range.

7. A throttle valve control device for an engine, comprising:

a throttle valve shaft arranged in a suction path of the engine;

a throttle valve pivotally arranged about said throttle valve shaft;

control means for generating a control signal for controlling an opening degree of said throttle valve in accordance with at least an amount of acceleration;

drive means for driving said throttle valve in accordance with said control signal;

wherein said throttle valve is controlled to pivot to a predetermined angular range of 90° or more exceeding a control angular range in a normal control between a predetermined angular position for a minimum control opening degree and a predetermined angular position for a maximum control opening degree;

a stopper for regulating pivoting of said throttle valve at a predetermined angular position out of said control angular range such that said throttle valve provides a predetermined opening degree when said drive means is deactivated; and a single spring urging said throttle valve in a rotational direction away from said control angular range toward said stopper.

8. The throttle valve control device according to claim 1, wherein said predetermined opening degree is greater than an opening degree for idling the engine.

* * * * *